US008216017B2

(12) United States Patent
Hsieh et al.

(10) Patent No.: US 8,216,017 B2
(45) Date of Patent: Jul. 10, 2012

(54) METHOD OF FABRICATING PLANAR LIGHT SOURCE

(75) Inventors: Yu-Heng Hsieh, Taipei (TW); Chu-Chi Ting, Hualien County (TW); Shinn-Haw Huang, Taoyuan County (TW); Chang-Jung Yang, Taoyuan County (TW); Chia-Hua Ai, Tainan County (TW)

(73) Assignee: Chunghwa Picture Tubes, Ltd., Taoyuan (TW)

( * ) Notice: Subject to any disclaimer, the term of this patent is extended or adjusted under 35 U.S.C. 154(b) by 371 days.

(21) Appl. No.: 12/545,868

(22) Filed: Aug. 24, 2009

(65) Prior Publication Data

US 2009/0311813 A1 Dec. 17, 2009

Related U.S. Application Data

(62) Division of application No. 11/308,967, filed on Jun. 1, 2006, now Pat. No. 7,612,502.

(51) Int. Cl.
*H01J 9/26* (2006.01)
*H01J 9/32* (2006.01)

(52) U.S. Cl. ..... 445/25; 445/9; 445/18; 445/22; 445/24; 445/33; 445/58; 313/485; 313/486; 313/582; 313/586; 313/587; 438/26; 438/27; 438/28; 438/29; 438/30

(58) Field of Classification Search ..... 445/9, 18, 445/22, 24, 25, 33, 58; 313/485, 486, 582, 313/586, 587; 438/26–30
See application file for complete search history.

(56) References Cited

U.S. PATENT DOCUMENTS

| | | | | |
|---|---|---|---|---|
| 5,182,489 | A * | 1/1993 | Sano | 313/485 |
| 6,100,633 | A * | 8/2000 | Okumura et al. | 313/486 |
| 7,394,197 | B2 * | 7/2008 | Song | 313/582 |
| 2002/0036466 | A1 * | 3/2002 | Tanaka et al. | 313/586 |
| 2002/0111102 | A1 * | 8/2002 | Ebihara et al. | 445/24 |
| 2004/0239245 | A1 * | 12/2004 | Kawamura et al. | 313/582 |
| 2007/0114928 | A1 * | 5/2007 | Chang et al. | 313/582 |

* cited by examiner

*Primary Examiner* — Bac Au
(74) *Attorney, Agent, or Firm* — Jianq Chyun IP Office

(57) ABSTRACT

In a method of fabricating a planar light source, a first substrate is formed at first. First electrodes approximately parallel to each other are formed on the first substrate. Sets of first dielectric patterns are formed on the first substrate. Each set of the first dielectric patterns includes at least two first striped dielectric patterns, and each of the first striped dielectric patterns covers one of the first electrodes correspondingly. The edges of the top of each first striped dielectric pattern are raised in a peak shape. A phosphor layer is formed between the first striped dielectric patterns of each set of the first dielectric patterns. A second substrate is formed. The first and second substrates are bound; meanwhile, a discharge gas is injected into the discharge space.

9 Claims, 9 Drawing Sheets

METHOD OF FABRICATING PLANAR LIGHT SOURCE

CROSS-REFERENCE TO RELATED APPLICATION

This application is a divisional application of and claims priority benefit of an U.S. application Ser. No. 11/308,967, filed on Jun. 1, 2006, now allowed. The entirety of the above-mentioned patent application is hereby incorporated by reference herein and made a part of this specification.

BACKGROUND OF THE INVENTION

1. Field of Invention

The invention relates to a light source and a method for fabricating the same. More particularly, the invention relates to a planar light source with high brightness and a method for fabricating the same.

2. Description of Related Art

Recently, the liquid crystal display (LCD) has gradually replaced the cathode ray tube (CRT) display and becomes a mainstream display in the market. However, the liquid crystal display panel cannot emit light by itself, so a back light module must be disposed below the liquid crystal display panel for providing a light source, so as to display pictures. As the light source provided by the back light module for the liquid crystal display panel is a surface light source, if a planar light source with high brightness is directly adopted for providing a surface light source for a liquid crystal display panel, the display brightness of the LCD can be enhanced.

FIG. 1 is a partial sectional view of a conventional planar light source. Referring to FIG. 1, a planar light source 100 includes an upper substrate 110, a lower substrate 120, electrode pairs 130, a dielectric layer 140, a phosphor layer 150, and ribs 160. The electrode pairs 130 are disposed on the lower substrate 120, and the dielectric layer 140 covers the electrode pairs 130. The phosphor layer 150 is disposed between the electrode pairs 130 and the surface of the upper substrate 110 facing to the lower substrate 120. The ribs 160 separate a plurality of discharge spaces 170 between the upper substrate 110 and the lower substrate 120, wherein the discharge spaces 170 are filled with discharge gas 180.

The illumination principle of the planar light source 100 is to generate high-energy electrons by the high voltage difference between the electrode pairs 130, and then hit the discharge gas 180 with the generated high-energy electrons, so as to generate so-called plasma. Afterward, activated atoms in an excited state in the plasma will emit ultraviolet rays when returning to the ground state, and then the emitted ultraviolet rays further activate the phosphor layer 150 in the planar light source 100 for emitting visible light.

With respect to the planar light source, how to enhance the illumination brightness has become one of the key issues under research and development. Moreover, the method for generating the high voltage difference described above adopts the electrode pairs 130 to accumulate charges through the dielectric layer 140 thereon, thereby activating the discharge gas 180 to generate plasma. As such, the shape of the dielectric layer 140 may affect the output of the plasma as well as the efficiency for generating ultraviolet rays, thereby affecting the illumination brightness of the planar light source.

SUMMARY OF THE INVENTION

In view of the above, the invention is directed to a planar light source, wherein the shape of the dielectric layer facilitates high brightness of the planar light source.

The invention is further directed to a method for fabricating a planar light source, so as to fabricate a planar light source with high brightness.

The invention provides a planar light source, which includes a first substrate, a second substrate, a sealant, a plurality of first electrodes, a plurality of sets of first dielectric patterns, a phosphor layer, and a discharge gas. The second substrate is disposed above the first substrate. The sealant is disposed between the first and second substrates to form a cavity between the first substrate, the second substrate, and the sealant. The first electrodes are disposed on the first substrate, and the first dielectric patterns are disposed on the first substrate, wherein each set of the first dielectric patterns has at least two first striped dielectric patterns, and each of the first striped dielectric patterns covers one of the first electrodes. The edges of the top of each first striped dielectric pattern are raised in a peak shape. Moreover, the phosphor layer is disposed between the first striped dielectric patterns in the same set. The discharge gas is injected in the cavity.

In one embodiment of the invention, the aforementioned planar light source further includes a plurality of spacers disposed in the cavity between the first and second substrates.

In one embodiment of the invention, the aforementioned phosphor layer is further coated on the surfaces of the spacers.

In one embodiment of the invention, the aforementioned planar light source further includes another phosphor layer disposed on the second substrate opposite to the first electrode on the first substrate.

In one embodiment of the invention, the aforementioned planar light source further includes a reflecting layer disposed on the first substrate, and the first electrodes are disposed on the reflecting layer.

In one embodiment of the invention, the height of the edges of the top of the first striped dielectric layers, for example, falls in the range of 3 to 30 μm.

In one embodiment of the invention, the aforementioned discharge gas is selected from a group consisting of xenon, neon, argon, helium, and deuterium gas.

In one embodiment of the invention, the aforementioned planar light source further includes a plurality of second electrodes disposed on the second substrate and opposite to the first electrodes, wherein each of the second electrodes is located corresponding to a space between the adjacent first electrodes.

In one embodiment of the invention, the aforementioned planar light source further includes a plurality of second striped dielectric patterns disposed on the second substrate and covering the second electrodes.

In one embodiment of the invention, the edges of the top of each second striped dielectric pattern are raised in a peak shape with a height between 3 to 30 μm.

The invention provides a method for fabricating the planar light source. First, a first substrate is provided, and a plurality of first electrodes are formed on the first substrate, wherein the first electrodes are approximately parallel to each other. Next, a plurality of sets of first dielectric patterns are formed on the first substrate, wherein each set of first dielectric patterns includes at least two striped dielectric patterns, and each first striped dielectric pattern covers a first electrode. The edges of the top of each first striped dielectric pattern are raised in a peak shape. A phosphor layer is formed between the first striped dielectric patterns in the same set. Then, a second substrate is provided, and the first and second substrates are bound. At the same time, a discharge gas is injected into the discharge spaces.

In one embodiment of the invention, the above-mentioned method for fabricating the striped dielectric patterns includes, for example, first forming a dielectric material layer on the first substrate to cover the first electrode, wherein the dielectric material layer includes solvent, bonding agent, and dielectric ceramic powder. Next, the dielectric material layer is heated to a first temperature, and is continuously heated under the first temperature for a first duration. Then, the dielectric material layer is heated to a second temperature, and is continuously heated under the second temperature for a second duration. Afterward, the dielectric material layer is heated to a third temperature, and is continuously heated under the third temperature for a third duration.

In one embodiment of the invention, the aforementioned third temperature is higher than the second temperature, and the second temperature is higher than the first one.

In one embodiment of the invention, the above-mentioned first temperature is 150° C., and the first duration is 10 minutes.

In one embodiment of the invention, the above-mentioned second temperature is 400° C., and the second duration is 20 minutes.

In one embodiment of the invention, the above-mentioned third temperature is 540° C., and the third duration is 20 minutes.

In one embodiment of the invention, the method for fabricating the first striped dielectric pattern includes an etching process or a sandblasting process.

In one embodiment of the invention, the method for fabricating the planar light source includes, before binding the first and second substrates, forming a plurality of spacers between the first and second substrates.

In one embodiment of the invention, the method for fabricating the planar light source further includes, before forming the first electrodes, forming a reflecting layer on the first substrate, and then forming the first electrodes on the reflecting layer.

In one embodiment of the invention, the method for fabricating the planar light source further includes, before binding the first and second substrates, forming another phosphor layer on the second substrate.

According to the invention, the top of the dielectric layer of the planar light source is designed to be a peak shape. Therefore, when a voltage is applied, the tip of the dielectric layer may accumulate more charge compared with the conventional amount, thus causing a phenomenon of point discharge, increasing the plasma generated by the discharge gas and the ultraviolet light generated by activating the plasma. As such, the phosphor layer can emit visible light with high brightness by absorbing plenty of ultraviolet rays, thereby enhancing the illumination brightness of the planar light source.

In order to make the aforementioned and other features and advantages of the invention comprehensible, embodiments accompanied with figures are described in detail below.

DESCRIPTION OF EMBODIMENTS

First Embodiment

Figure 1:
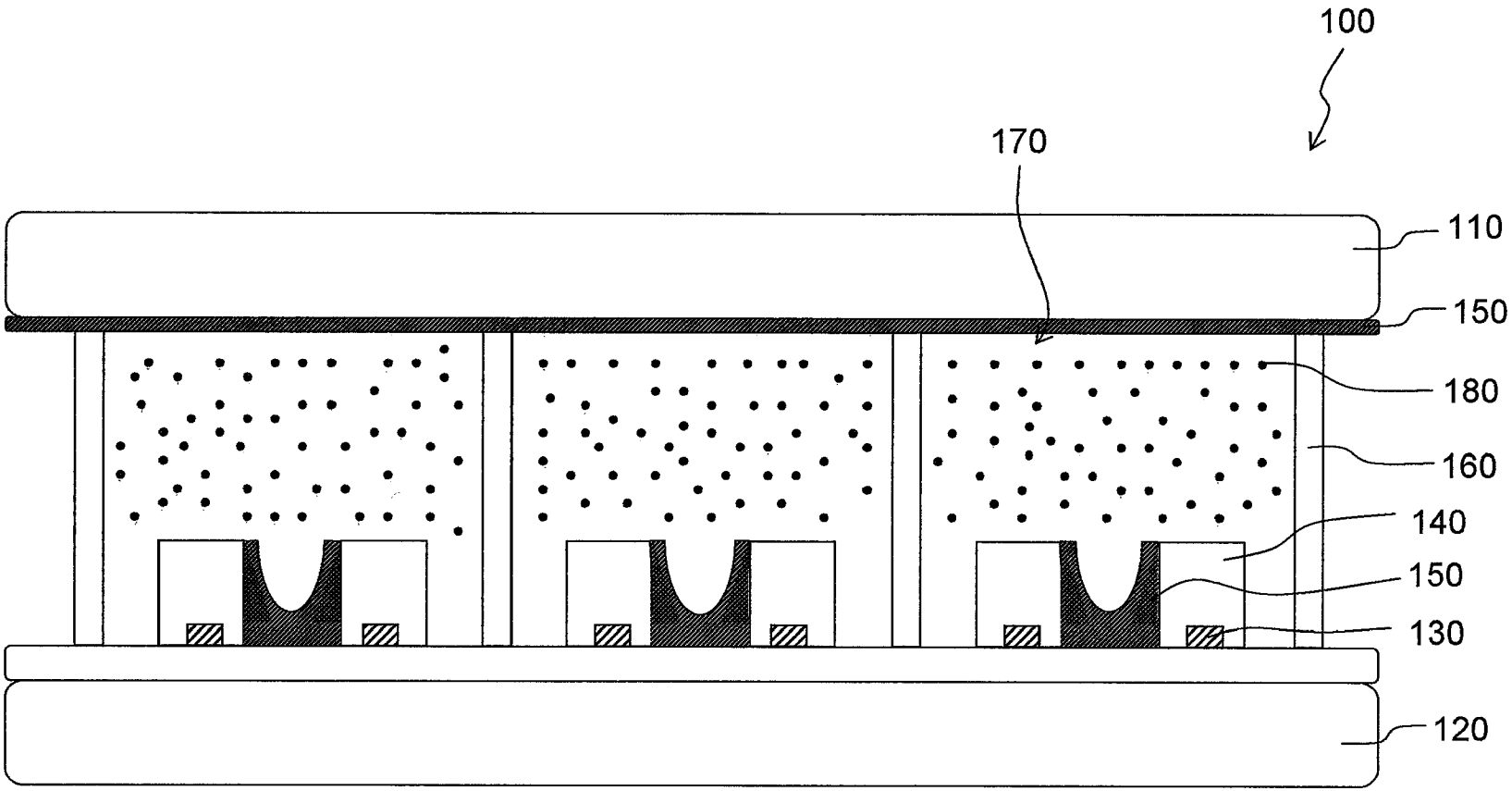
FIG. 1(PRIOR ART)
FIG. 1 is a partial sectional view of a conventional planar light source.
Figure 2A:
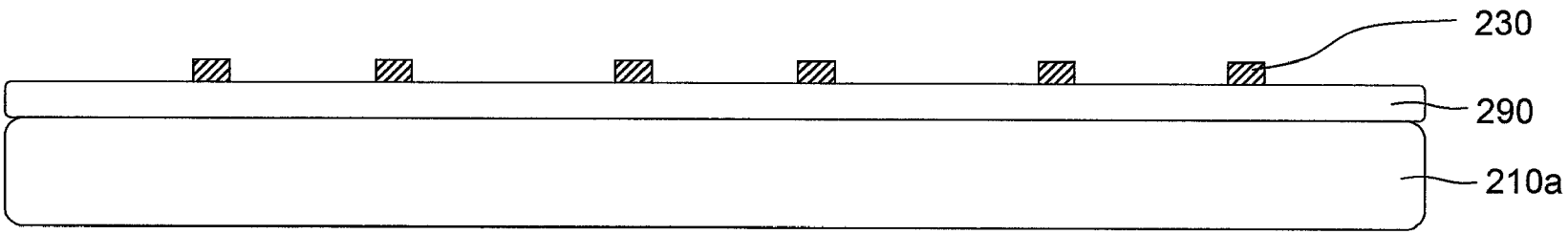
FIGS. 2A to 2D are sectional views of the fabricating process of a planar light source according to the first embodiment of the invention.

FIGS. 2A to 2D depict the flow chart of fabricating a planar light source according to the first embodiment of the invention. Referring to FIG. 2A, first, a first substrate 210*a* is provided, and a plurality of first electrodes 230 in parallel are formed on the first substrate 210*a*. It should be noted that in order to improve the light utilization of the planar light source, the present embodiment, for example, adopts forming a reflecting layer 290 on the first substrate 210*a* before forming the first electrodes 230, and then forming the first electrodes 230 on the reflecting layer 290. Of course, in other embodiments, the reflecting layer (not shown) can also be disposed on the lower surface of the first substrate 210*a* without first electrodes 230, which is not limited by the invention.

Figure 2B:
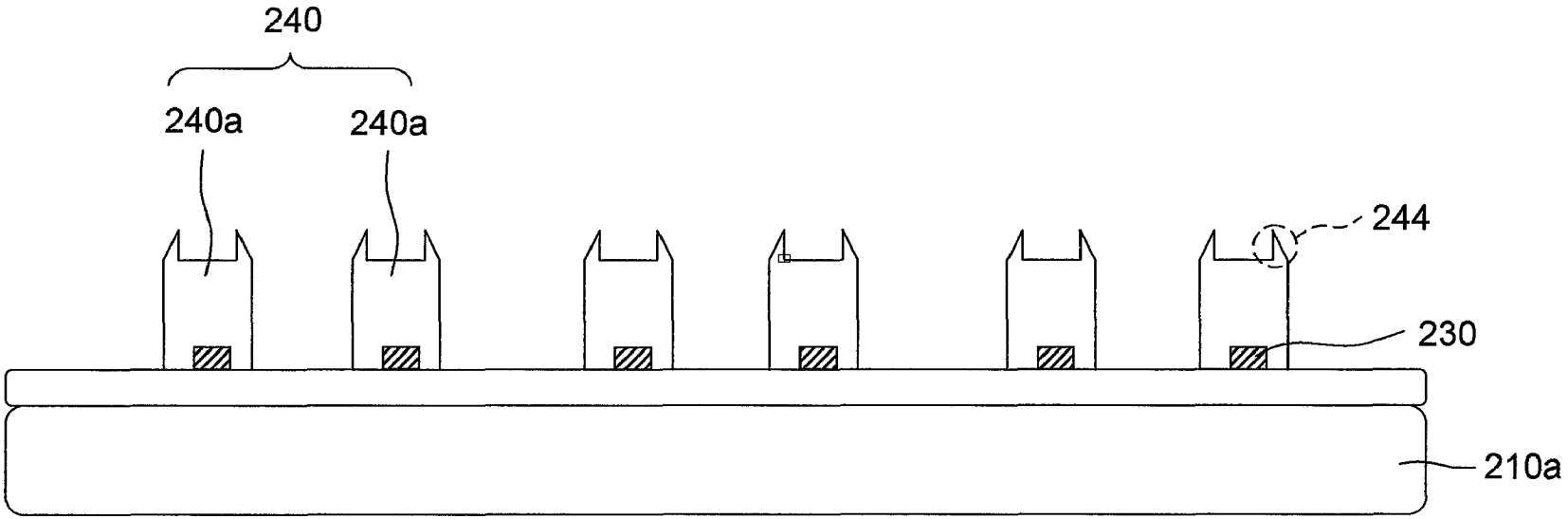

Next, as shown in FIG. 2B, a plurality of sets of first dielectric patterns 240 are formed on the first substrate 210*a*, wherein each set of first dielectric patterns 240 at least includes two first striped dielectric patterns 240*a*, and each first striped dielectric pattern 240*a* covers a first electrode 230. Particularly, the edges 244 of the top of the first striped dielectric pattern 240*a* are raised in a peak shape. As such, when voltages are applied to the first electrodes 230, the edges 244 of the top of the first striped dielectric patterns 240*a* can accumulate more charge compared with other parts of the first striped dielectric patterns 240*a*, thus causing the point discharge.

Figure 3:
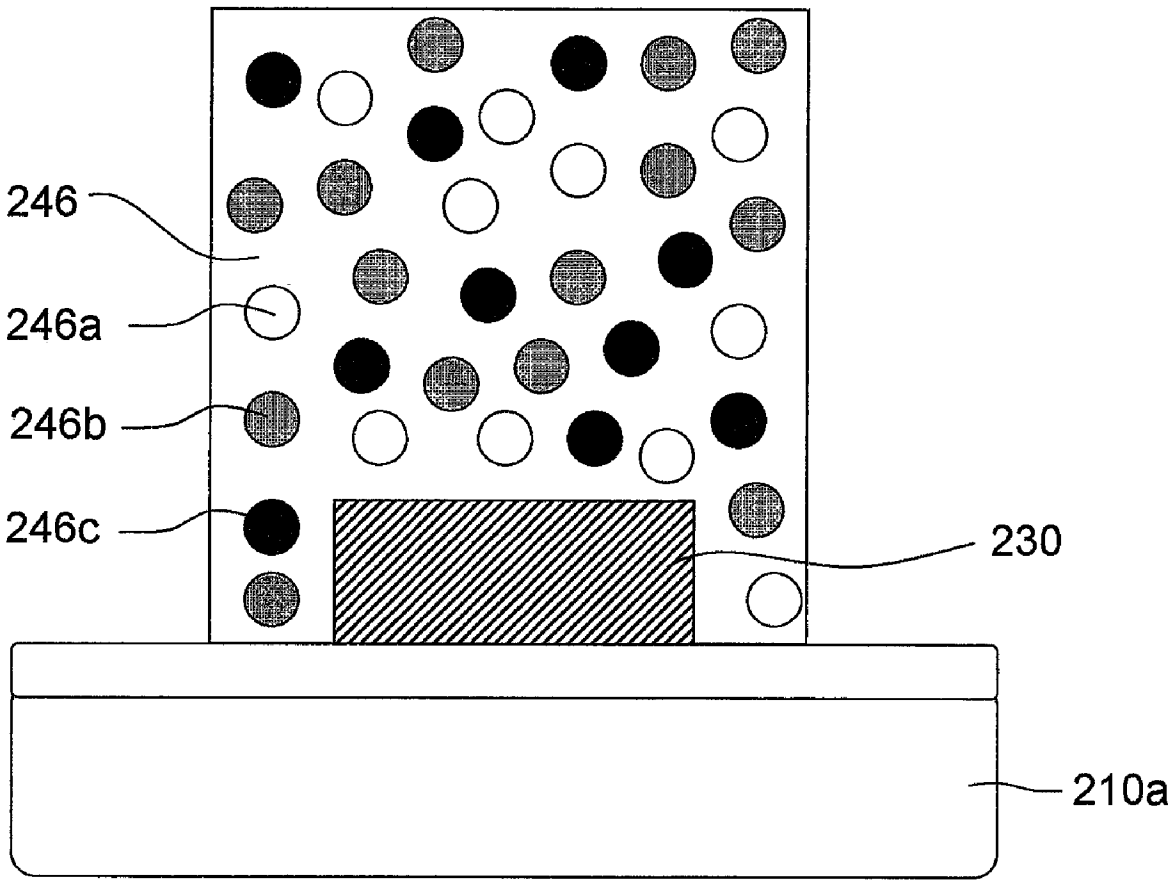
FIG. 3 is an enlarged schematic view after a dielectric material layer is formed on the first substrate according to the first embodiment of the invention.
Figure 4:
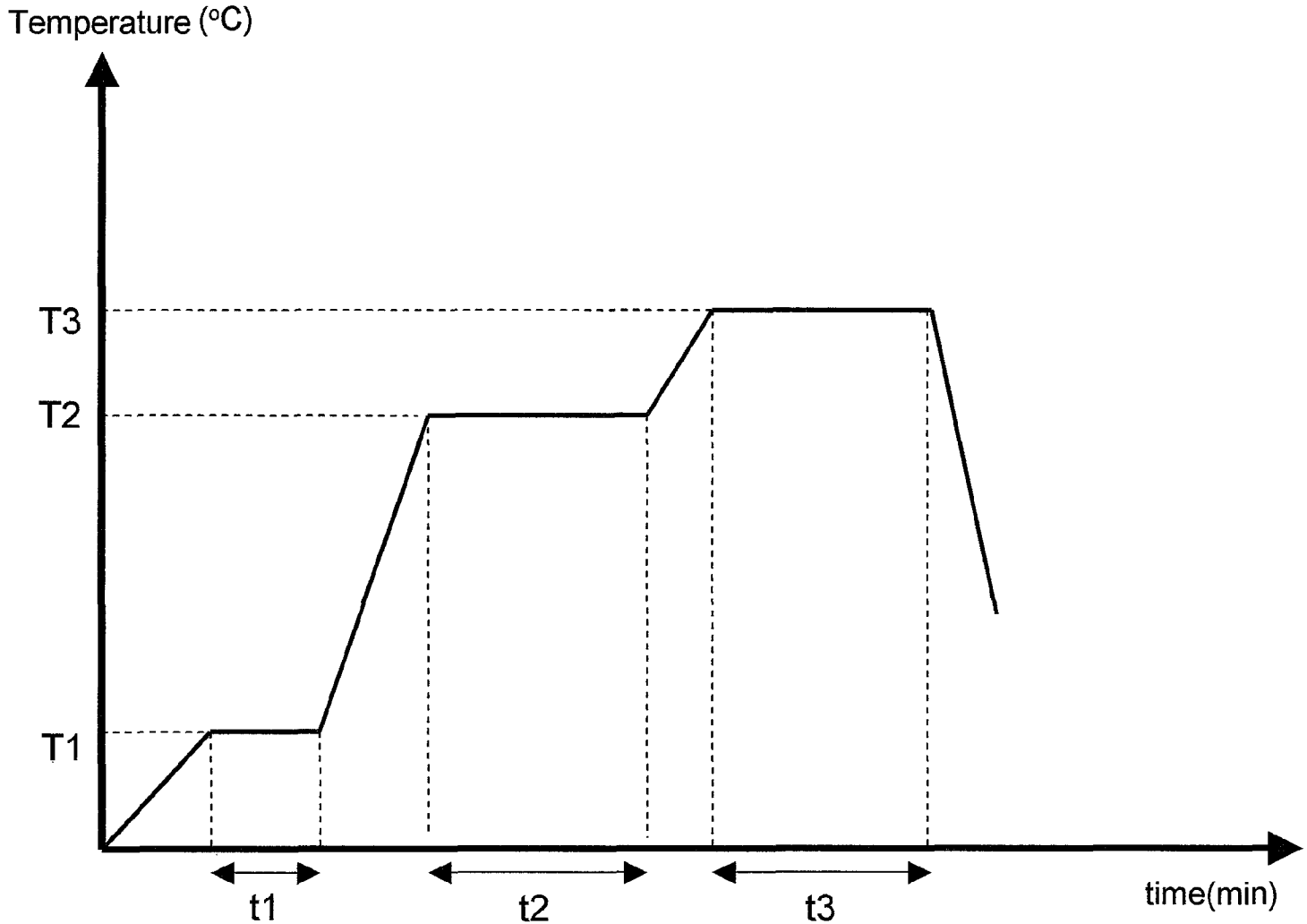
FIG. 4 is a curve graph depicting the time-temperature relation for forming the first striped dielectric pattern.

The method for forming the first striped dielectric pattern 240*a* will be illustrated below with the embodiments, but the invention will not be limited to these embodiments. FIG. 3 is an enlarged schematic view of the embodiment after the dielectric material layer is formed on the first substrate. FIG. 4 is a curve graph depicting the time-temperature relation for forming the first striped dielectric pattern 240*a*.

Referring to FIGS. 3 and 4, according to the embodiment, the method for forming the first striped dielectric pattern 240*a* is first, forming a dielectric material layer 246 to cover the first electrode 230, wherein the dielectric material layer 246 usually contains solvent 246*a*, bonding agent 246*b*, and dielectric ceramic powder 246*c*; then, heating the dielectric material layer 246 to the temperature T1, and keeping heating under the temperature T1 for the duration t1, so as to evaporate the solvent 246*a* from the dielectric material layer 246. Herein, the temperature T1 is, for example, 150° C., and the duration t1 is, for example, 10 minutes.

Then, the dielectric material layer 246 is heated from the temperature T1 to the temperature T2, and is continuously heated under the temperature T2 for the duration t2, so as to evaporate the solvent 246*b* from the dielectric material layer 246. Herein, the temperature T2 is, for example, 400° C., and the duration t2 is, for example, 20 minutes. Afterward, the dielectric material layer 246 is heated from the temperature T2 to the temperature T3, and is continuously heated under the temperature T3 for the duration t3, so as to sinter the dielectric ceramic powder 246*c* from the dielectric material layer 246. Finally, the dielectric material layer 246 is cooled down to the normal temperature. Herein, the temperature T3 is, for example, 540° C., and the duration t3 is, for example, 20 minutes.

After the steps of heating, the formed first striped dielectric pattern 240*a* is shown in FIG. 2B, i.e., the edges 244 of the top are raised in a peak shape.

Of course, those skilled in the art should understand that the first striped dielectric pattern 240*a* in FIG. 2B can be fabricated by other methods, such as etching process or sandblasting process according to other embodiments of the invention.

Figure 2C:
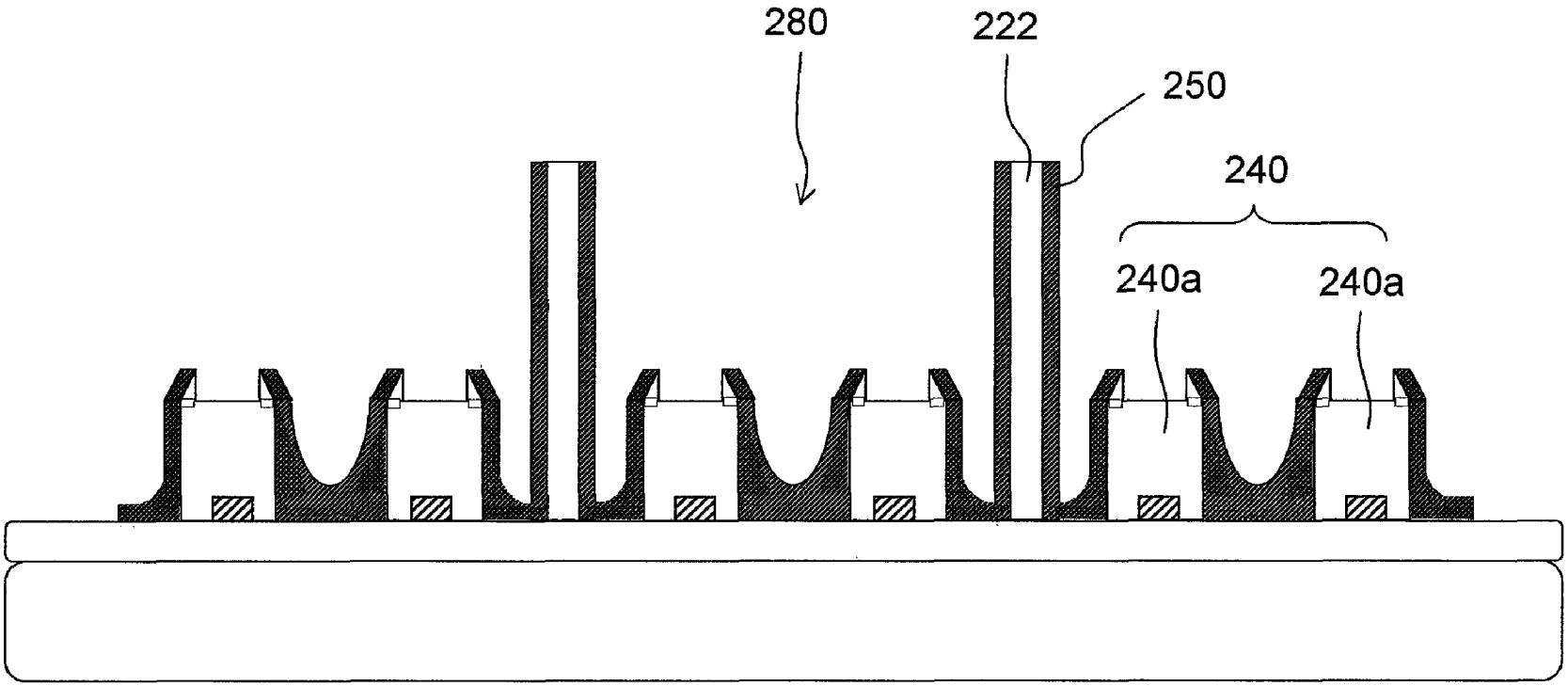

Referring to FIG. 2C, after the first striped dielectric patterns 240*a* are formed, a spacer 222, for example, is first formed between each set of first dielectric patterns 240 for isolating a plurality of discharge spaces 280. Then, a phosphor layer 250 is formed between the first striped dielectric patterns 240*a* in the discharge spaces 280. It should be noted that the phosphor layer 250 can cover the first striped dielectric patterns 240*a* and the sidewall of the spacers 222 at the same time.

Figure 2D:
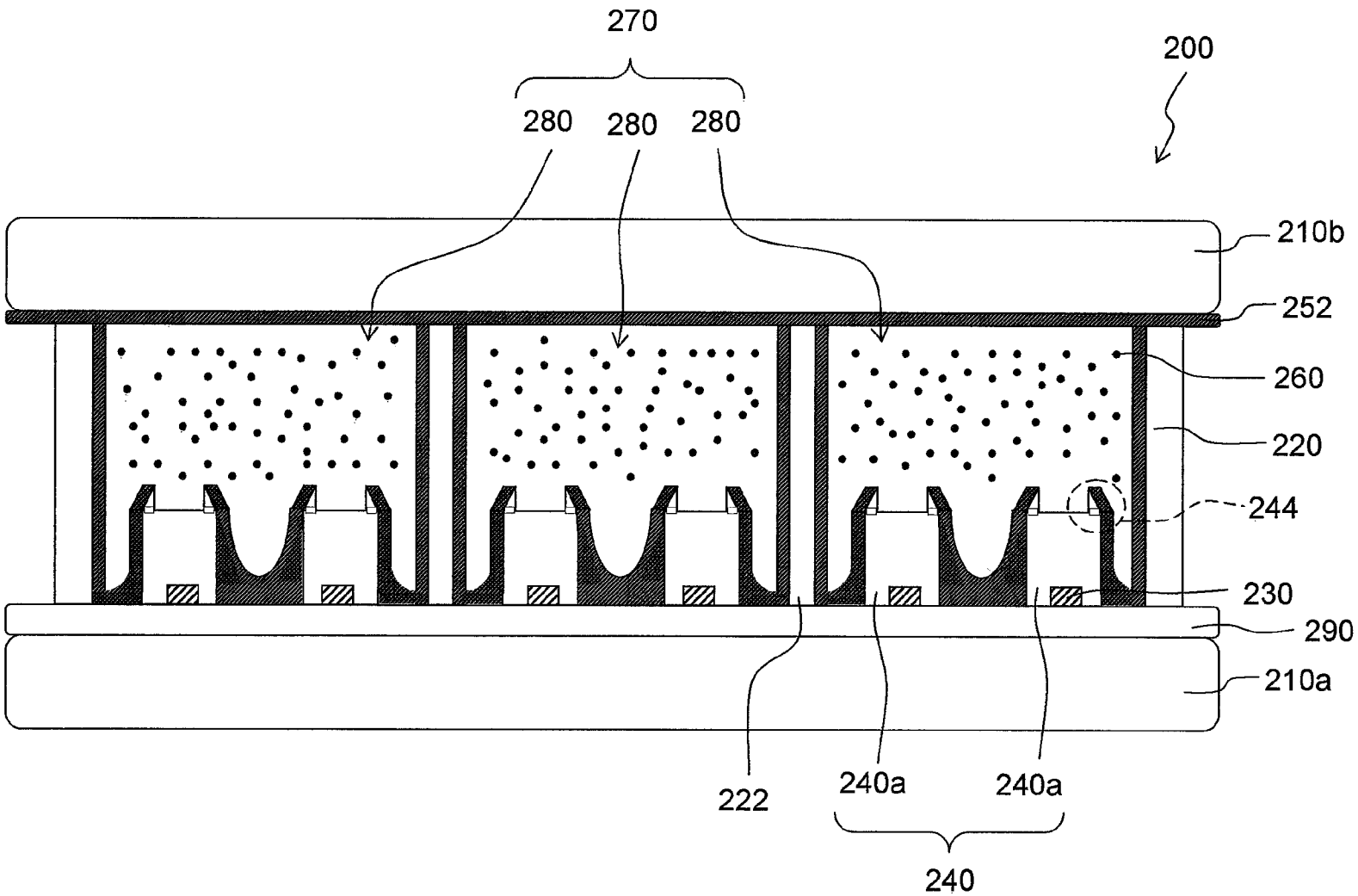

Next, referring to FIG. 2D, a second substrate 210*b* is provided, and the second substrate 210*b* is bound above the first substrate 210*a* by using a sealant 220. Meanwhile, a discharge gas 260 is injected between the first substrate 210*a* and the second substrate 210*b*, i.e., the fabricating process of the planar light source 200 is approximately finished. The discharge gas 260 can be, for example, xenon, neon, argon, helium, deuterium gas, or other discharge gas. Besides, a phosphor layer 252, for example, has already been formed on the second substrate 210*b*.

The planar light source fabricated according to the above embodiment will be illustrated below. Referring to FIG. 2D, the planar light source 200 includes a first substrate 210*a*, a second substrate 210*b*, a sealant 220, a plurality of first electrodes 230, a plurality of sets of first dielectric patterns 240, a phosphor layer 250, and a discharge gas 260. The second substrate 210*b* is disposed above the first substrate 210*a*. The sealant 220 is disposed between the first substrate 210*a* and the second substrate 210*b* to form a cavity 270 between the first substrate 210*a*, the second substrate 210*b*, and the sealant 220. The first electrodes 230 and the sets of the first dielectric patterns 240 are all disposed on the first substrate 210*a*. A reflecting layer 290 is further disposed on the first substrate 210*a*, and the first electrodes 230 and the first dielectric patterns 240 are disposed on the reflecting layer 290.

Particularly, each set of the first dielectric patterns 240 at least includes two first striped dielectric patterns 240*a*, and each of the first striped dielectric patterns 240*a* covers a first electrode 230. More particularly, the edges 244 of the top of each first striped dielectric pattern 240*a* are raised in a peak shape, so during the discharge process of the planar light source 200, the edges 244 of the top of the first striped dielectric pattern 240*a* can accumulate more charge compared with other parts, thereby causing the point discharge.

Figure 5:
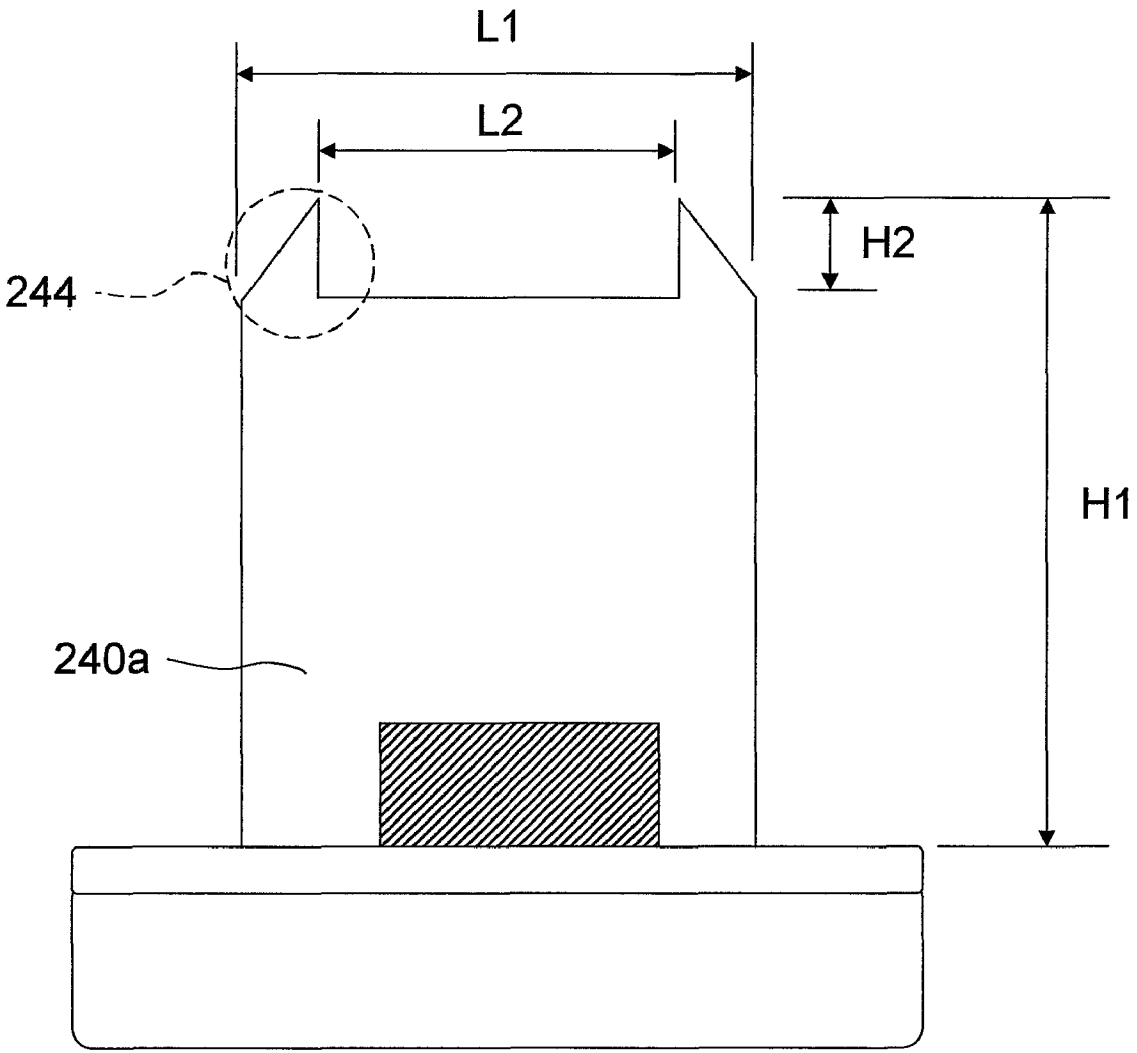
FIG. 5 is an enlarged schematic view of the first striped dielectric pattern in FIG. 2D.

The first striped dielectric pattern will be illustrated below, but the invention will not be limited to this. FIG. 5 is an enlarged schematic view of the first striped dielectric pattern 240*a* in FIG. 2D. Referring to FIG. 5, the width of the first striped dielectric pattern 240*a* is L1, and the height is H1. The height of two edges 244 of the top of the first striped dielectric pattern 240*a* is H2, and the pitch between two peak shaped edges 244 of the same first striped dielectric pattern 240*a* is L2. In the embodiment, the width L1 of the first striped dielectric pattern 240*a* is about 1 to 5 cm, and the height H1 is about 50 to 400 μm. The pitch L2 between two peak shaped edges 244 of the top is about 1 to 4 cm, and the height H2 falls in the range of 3 to 30 μm.

Referring to FIG. 2D again, the phosphor layer 250 is disposed between the first striped dielectric patterns 240*a* in each of the discharge spaces 280. Of course, another phosphor layer 252 can also be disposed on the second substrate 210*b*. The discharge gas 260 is injected into each of the discharge spaces 280 of the cavity 270, and can be, for example, xenon, neon, argon, helium, deuterium gas, or other discharge gas. Besides, the spacers 222 can be further disposed between the first substrate 210*a* and the second substrate 210*b* for keeping the pitch between the first substrate 210*a* and the second substrate 210*b*.

In view of the above, the edges 244 of the top of the first striped dielectric pattern 240*a* are raised in a peak shape, which results in point discharge and thereby increasing the plasma generated during the discharge process, so as to increase the ultraviolet light generated by activating the plasma and further improve the brightness of the visible light emitted by the phosphor layer 250. As such, the illumination brightness of the planar light source 200 can be effectively enhanced.

Second Embodiment

Figure 6:
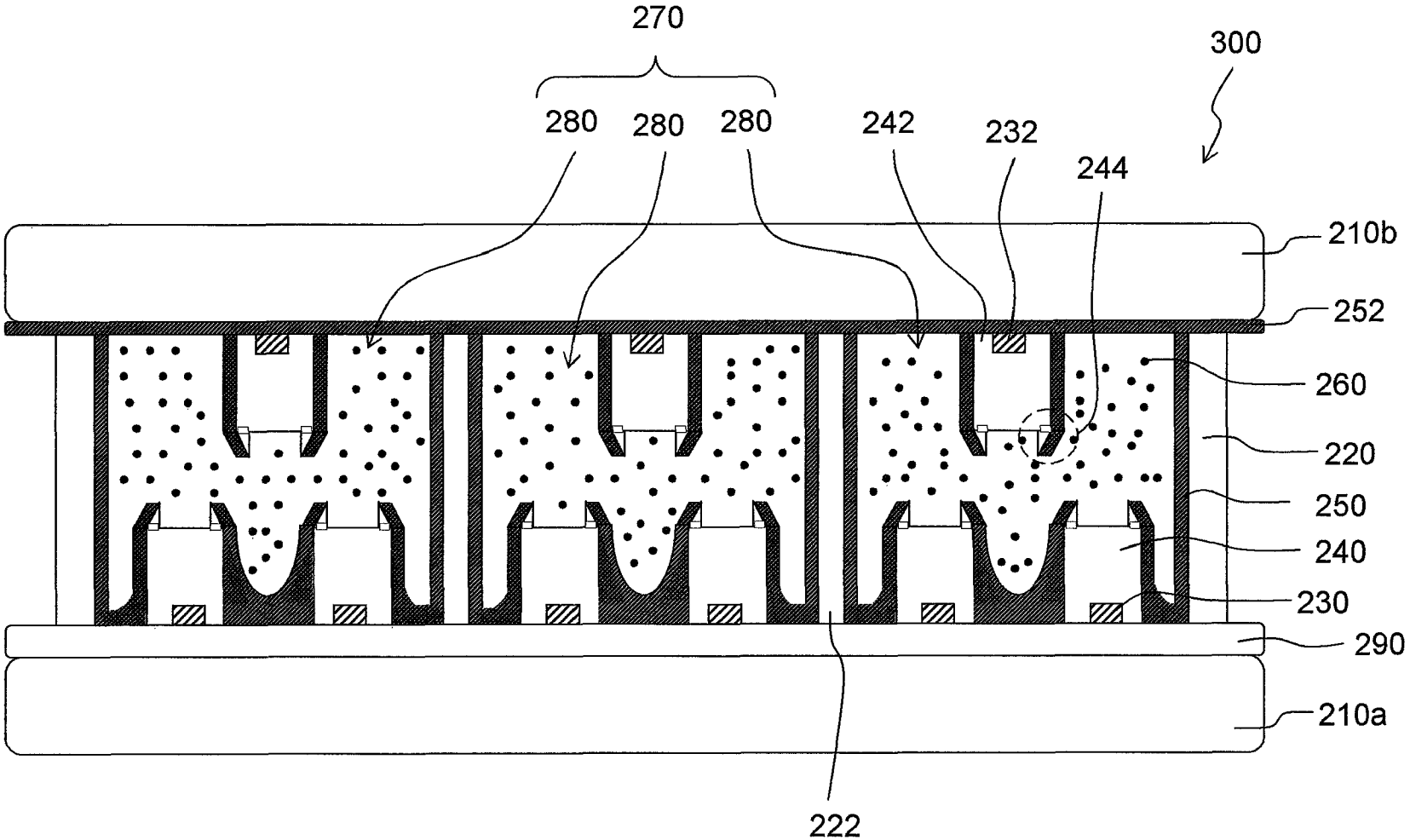
FIG. 6 is a sectional view of a planar light source according to the second embodiment of the invention.

FIG. 6 is a sectional view of a planar light source according to the second embodiment of the invention. Referring to FIG. 6, the difference between the planar light source 300 and the planar light source 200 of the above embodiment is that the second electrodes 232 and second dielectric patterns 242 are formed on the second substrate 210*b*. The fabricating processes and structures of the first electrodes 230, the first dielectric patterns 240, the phosphor layer 250, the reflecting layer 290 etc. on the first substrate 210*a* of the planar light source 300 are identical or similar to that of the above-mentioned fabricating method, which will not be described herein.

In the embodiment, before the first substrate 210*a* and the second substrate 210*b* are bound, a plurality of second electrodes 232 are disposed on the second substrate 210*b*, wherein each of the second electrodes 232 is disposed in a discharge space 280 after the first substrate 210*a* and the second substrate 210*b* are bound. Next, a plurality of second striped dielectric patterns 242 are formed on the second substrate 210*b*,and each of the second striped dielectric patterns 242 covers a second electrode 232. Herein, the method for fabricating the second striped dielectric pattern 242 is identical or similar to that of the first striped dielectric pattern 240. As such, the edges 244 of the top of the second striped dielectric pattern 242 are raised in a peak shape. After that, the phosphor layer 252 disposed on the second substrate 210*b* is disposed on the sidewall of the second striped dielectric pattern 242.

In view of the above, as the edges of the top of the striped dielectric pattern in the planar light source are raised in a peak shape, a point discharge is induced, thereby enhancing the illumination brightness of the planar light source.

Though the invention has been disclosed above by the embodiments, it is not intended to limit the invention. Anybody skilled in the art can make some modifications and variations without departing from the spirit and scope of the invention. Therefore, the protecting range of the invention falls in the appended claims.

What is claimed is:

1. A method of fabricating a planar light source, comprising:

providing a first substrate;

forming a plurality of first electrodes on the first substrate, wherein the first electrodes are approximately parallel to each other;

forming a plurality of sets of first dielectric patterns on the first substrate, wherein each set of the first dielectric patterns comprises at least two first striped dielectric patterns, and each of the first striped dielectric patterns covers one of the first electrodes correspondingly, wherein the edges of the top of each first striped dielectric pattern are raised in a peak shape;

wherein the method for fabricating the first striped dielectric patterns comprises:

forming a dielectric material layer on the first substrate to cover the first electrodes, wherein the dielectric material layer comprises a solvent, a bonding agent, and a dielectric ceramic powder;

heating the dielectric material layer to a first temperature, and continuously heating the dielectric material layer under the first temperature for a first duration;

heating the dielectric material layer to a second temperature, and continuously heating the dielectric material layer under the second temperature for a second duration; and heating the dielectric material layer to a third temperature and continuously heating the dielectric material layer under the third temperature for a third duration;

forming a phosphor layer between the first striped dielectric patterns of each set of the first dielectric patterns;

providing a second substrate; and binding the first and second substrates, and meanwhile injecting a discharge gas into the discharge space.

2. The method of fabricating the planar light source according to claim 1, wherein the third temperature is higher than the second temperature and the second temperature is higher than the first temperature.

3. The method of fabricating the planar light source according to claim 1, wherein the first temperature is 150° C. and the first duration is 10 minutes.

4. The method of fabricating the planar light source according to claim 1, wherein the second temperature is 400° C. and the second duration is 20 minutes.

5. The method of fabricating the planar light source according to claim 1, wherein the third temperature is 540° C. and the third duration is 20 minutes.

6. The method of fabricating the planar light source according to claim 1, wherein the method for forming the first striped dielectric patterns comprises an etching process or a sandblasting process.

7. The method of fabricating the planar light source according to claim 1, before binding the first and second substrates, further comprising forming a plurality of spacers between the first and second substrates.

8. The method of fabricating the planar light source according to claim 1, before forming the first electrodes, further comprising forming a reflecting layer on the first substrate, wherein the first electrodes formed later are disposed on the reflecting layer.

9. The method of fabricating the planar light source according to claim 1, before binding the first and second substrates, further comprising forming another phosphor layer on the second substrate.

* * * * *